US007740330B2

(12) United States Patent
Huang et al.

(10) Patent No.: US 7,740,330 B2
(45) Date of Patent: Jun. 22, 2010

(54) SLIDE RAIL

(75) Inventors: Kuo-Ming Huang, Taipei Hsien (TW); Mo-Ming Yu, Shenzhen (CN); Hai-Chen Zhou, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 158 days.

(21) Appl. No.: 11/947,775

(22) Filed: Nov. 30, 2007

(65) Prior Publication Data

US 2008/0142666 A1 Jun. 19, 2008

(30) Foreign Application Priority Data

Dec. 15, 2006 (TW) ..... 95147324 A

(51) Int. Cl.
*A47B 88/00* (2006.01)

(52) U.S. Cl. ..... 312/334.8

(58) Field of Classification Search ..... 312/334.16, 312/334.1, 334.4, 334.7, 334.8, 350; 384/20, 384/23

See application file for complete search history.

(56) References Cited

U.S. PATENT DOCUMENTS

| | | | | | |
|---|---|---|---|---|---|
| 1,496,099 | A | * | 6/1924 | O'Connor | 70/86 |
| 3,133,768 | A | * | 5/1964 | Klakovich | 384/17 |
| 5,209,572 | A | | 5/1993 | Jordan | |
| 5,403,097 | A | * | 4/1995 | Woof | 384/20 |
| 6,145,945 | A | * | 11/2000 | Parvin | 312/334.46 |

FOREIGN PATENT DOCUMENTS

CN 2058572 U 6/1990

* cited by examiner

*Primary Examiner*—Janet M Wilkens
*Assistant Examiner*—Matthew W Ing
(74) *Attorney, Agent, or Firm*—Frank R. Niranjan

(57) ABSTRACT

A slide rail includes a first slide, a second slide, and a third slide, each of the first slide, the second slide, and the third slide comprising a pair of sidewalls. The first slide further includes a bottom wall, the pair of the sidewalls are extended from two edges of the bottom wall respectively. The second slide is received in a space bounded by the bottom wall and the sidewalls of the first slide; the sidewalls of the second slide extend out from the space to contact the sidewalls of the third slide.

16 Claims, 3 Drawing Sheets

SLIDE RAIL

BACKGROUND

1. Field of the Invention

The present invention generally relates to slide rails. Particularly, the present invention relates to slide rails with adequate space between slides.

2. Description of Related Art

Slide rails are used for guiding objects, such as drawers, to be pushed into or pulled out from bodies, such as furniture. There are many kinds of slide rails, some have ball bearings and others do not. Slide rails having ball bearings are easy to be pulled or pushed, for they have little friction. However, the ball bearings add to the cost of the slide rails, and brackets for supporting the ball bearings tend to break, which causes the slide rails to become unusable. Slide rails without ball bearings have lower costs than those having ball bearings. Such slide rails have at least two slides movable relative to each other.

In the slide rails, locks are typically installed between the slides for preventing unwanted movement of the slides. Only when the locks are unlocked, the slides may move relative to each other. Therefore, adequate space between the slides is needed for installing the locks.

SUMMARY

In one embodiment, a slide rail includes a first slide, a second slide, and a third slide, each of the first slide, the second slide, and the third slide comprising a pair of sidewalls. The first slide further includes a bottom wall, the pair of the sidewalls are extended from two edges of the bottom wall. The second slide is received in a space bounded by the bottom wall and the sidewalls of the first slide; the sidewalls of the second slide extend out from the space to contact the sidewalls of the third slide.

Other advantages and novel features of the slide rail will become more apparent from the following detailed description of preferred embodiments when taken in conjunction with the accompanying drawings, in which:

DETAILED DESCRIPTION

Figure 1:
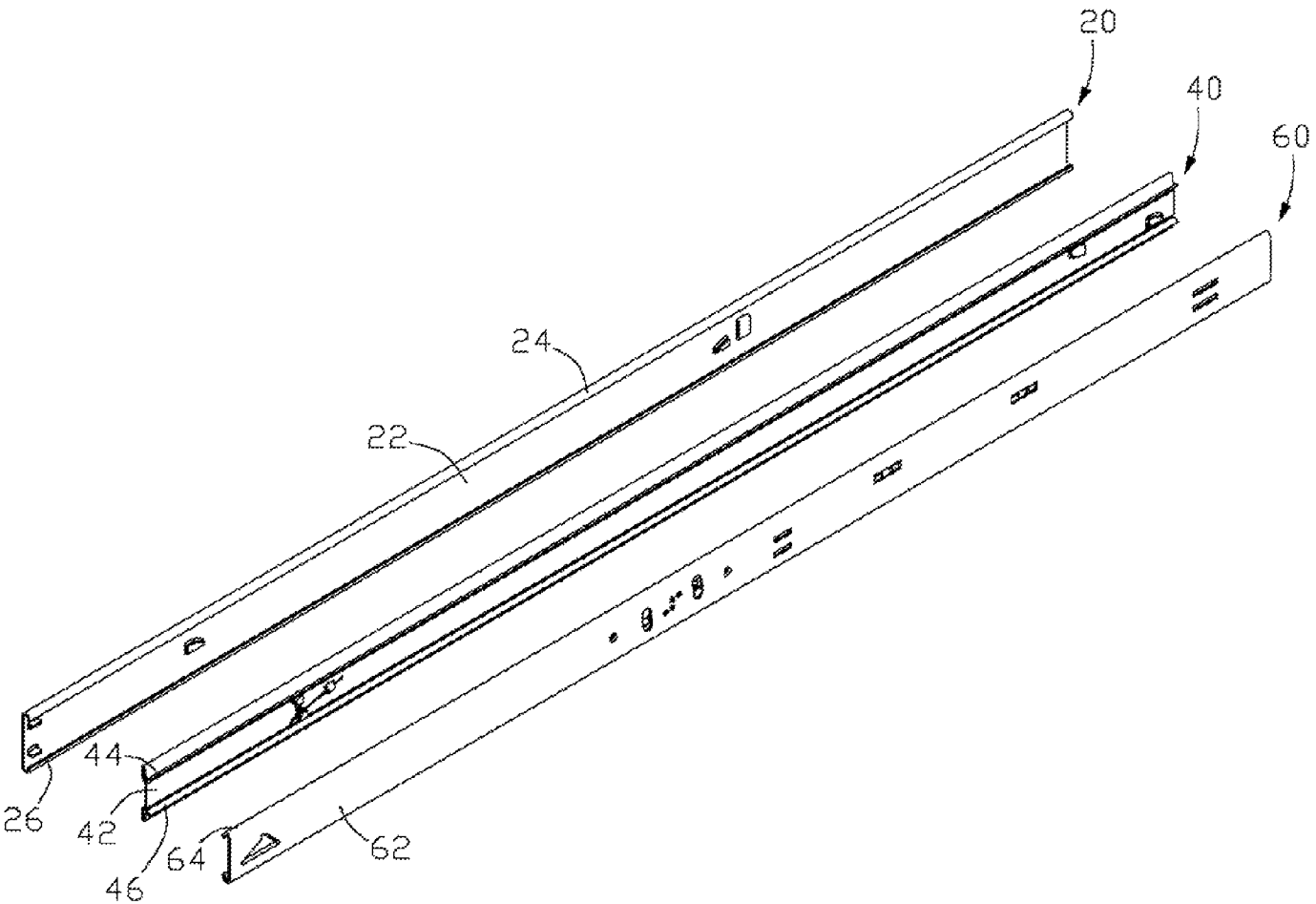
FIG. 1 is a perspective view of a slide rail in accordance with an exemplary embodiment of the present invention.
Figure 2:
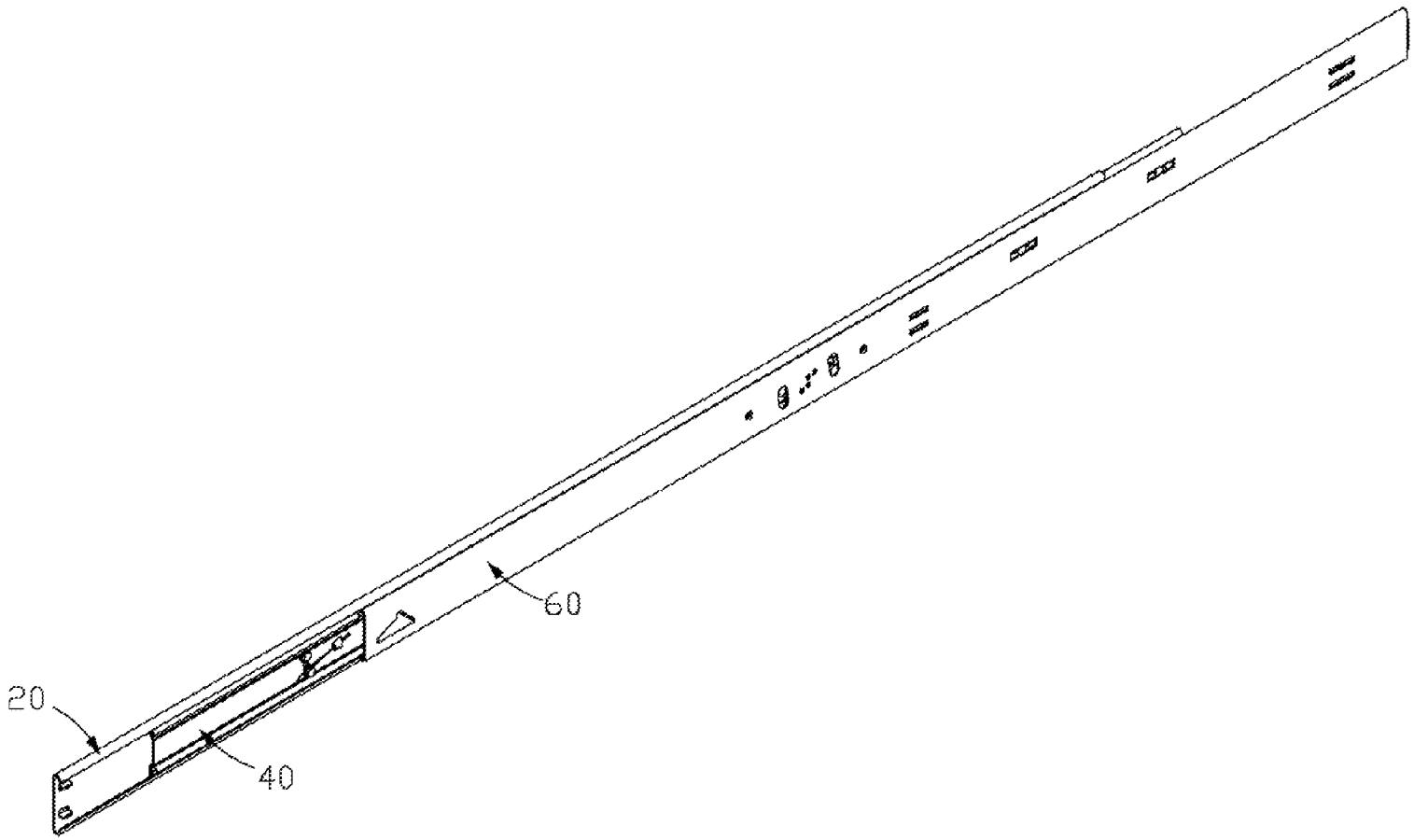
FIG. 2 is an assembled view of the slide rail of FIG. 1.

Referring to FIGS. 1 and 2, a slide rail in accordance with an exemplary embodiment includes a first slide 20, a second slide 40, and a third slide 60. The first slide 20 is used for being fixed on a stable object, like a kind of furniture, such as racks for servers. The third slide 60 can be fixed on a movable object, such as servers to be installed in the racks. The second slide 40 is received in the first slide 20, and installed between the first slide 20 and the third slide 60. The second slide 40 is movable relative to the first slide 20 and the third slide 60. Through the motion between the three slides, the movable object can be pushed into or pulled out from the stable object.

Figure 3:
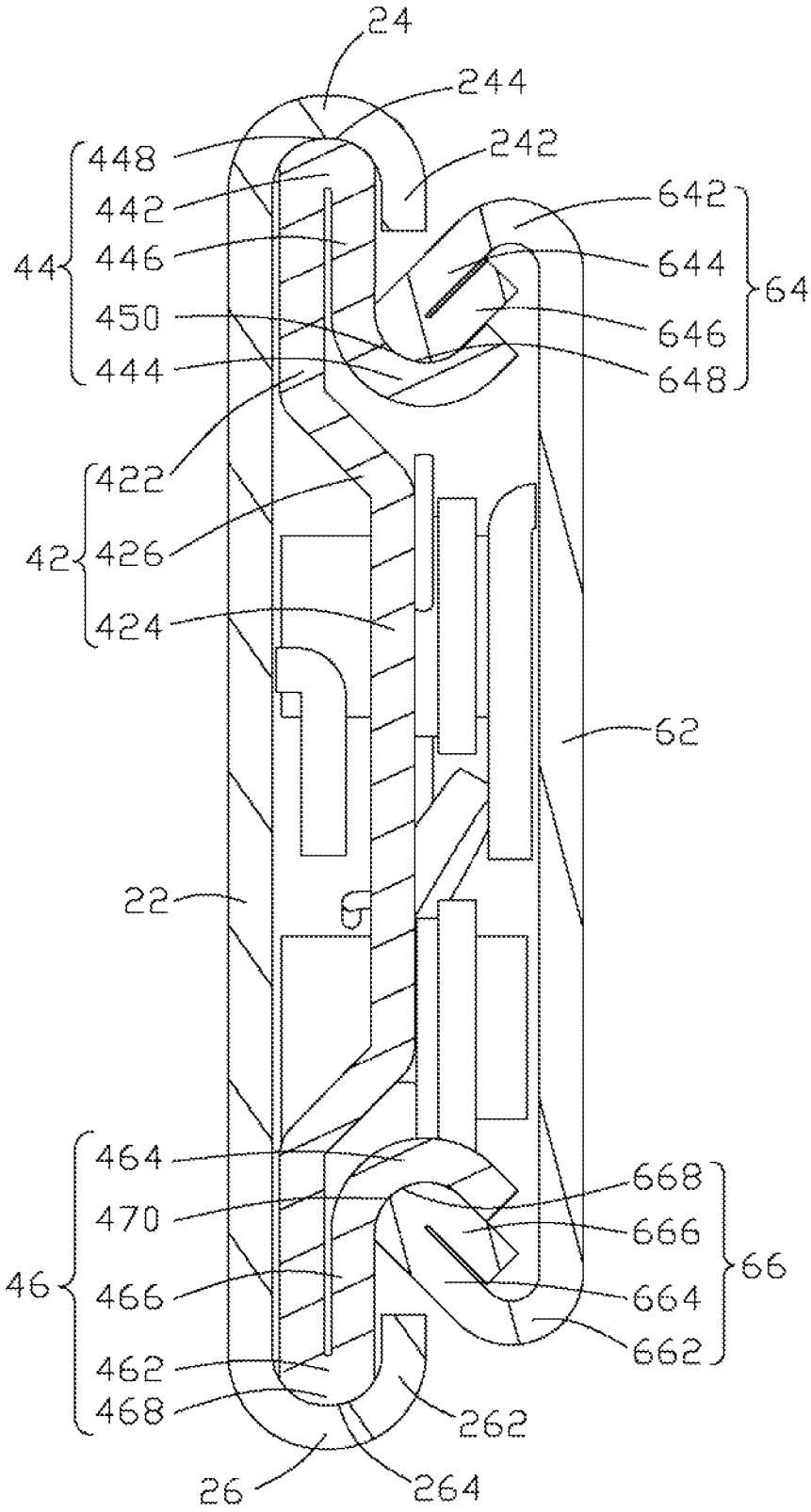
FIG. 3 is a cross-sectional view of the slide rail of FIG. 2.

Referring to FIG. 3, the first slide 20 includes a bottom wall 22 and a pair of sidewalls 24, 26. The bottom wall 22 extends in the longitudinal direction, along with the sidewalls 24 and 26. The two sidewalls 24 and 26 are extended from two edges of the bottom wall 22, in a direction towards an identical surface of the bottom wall 22. Ends 242 and 262 of the two sidewalls 24 and 26 are respectively turned inward to be generally parallel with the bottom wall 22. At each inner side of the sidewalls 24 and 26, first recesses 244, 264 are provided respectively. A volume of a first space, which is bounded by the bottom wall 22 and the sidewalls 24, 26 is determined by the extent that the sidewalls 24, 26 extend from the bottom wall 22.

The second slide 40 includes a main plate 42 and two side parts 44, 46. The two side parts 44 and 46 are symmetrically disposed on two sides of the main plate 42, integrally extending from the main plate 42 respectively.

The main plate 42 includes a pair of end portions 422, a flat panel 424, and a pair of connection portions 426. The end portions 422 are disposed on two edges of the flat panel 424, and are parallel with the flat panel 424 respectively, which is parallel with the bottom wall 22 of the first slide 20 after assembly. The connection portions 426 connect the pair of end portions 422 and the flat panel 424 at two edges of the flat panel 424, respectively. The connection portions 426 are symmetrically inclined to the flat panel 424. After assembly, the endings 422 are nearer the bottom wall 22 than the flat panel 424.

The side parts 44 and 46 have generally the same structure, so the side part 46 is mainly described below for simplicity. The side part 46 includes a first curve 462, a second curve 464, and a connection portion 466. The first curve 462 is extended from the end portion 422 of the main plate 42. The first curve 462 interconnects the end portion 422 and the connection portion 466, which is parallel with the end portion 422. A first camber 468 is provided on an outer surface of the first curve 462. The curvature of the first camber 468 is the same as the curvature of the first recess 264 of the first slide 20. The connection portion 466 is generally extended from the first curve 462 in a direction approaching the inclined connection portion 426 of the main plate 42. On the end of the extension, the second curve 464 extends from the connection portion 466 in a direction away from the connection portion 426 of the main plate 42. Accordingly, a second recess 470 is provided in an inner surface of the second curve 464.

Similarly, the side part 44 includes a first curve 442, a second curve 444, and a connection portion 446. The connection portion 446 interconnects the first curve 442 and the second curve 444. The first curve 442 provides a first camber 448 on the outer surface thereof, and the second curve 444 provides a second recess 450 on the inner surface thereof. Thus, the connection portions 446, 464 of the side parts 44, 46 extend toward each other, and the extension ends of the second curves 444, 464 extend from each other.

The third slide 60 includes an installation plate 62 and two arms 64, 66 symmetrically disposed on two sides of the installation plate 62, respectively. The installation plate 62 can be fixed to the movable object when in use, and is parallel with the bottom wall 22 of the first slide 20 after assembly. The arms 64 and 66 that have symmetrically the same structures are used for clamping the second slide 40 when assembled.

The arm 64 includes a bent portion 642, a clamp plate 644, and a free end 646. The bent portion 642 interconnects the installation plate 62 and the clamp plate 644. The bent portion 642 is set in such a manner that, the extension end of the clamp plate 644 other than its opposite end that is connected to the bent portion 642, points at the second curve 444, and is received in the second curve 450 of the second curve 444.

The extension end of the clamp plate 644, other than its opposite end that is connected to the bent portion 642, is turned back to form the free end 646. The free end 646 is generally parallel with the clamp plate 644. At the intersection of the clamp plate 644 and the free end 646, a second camber 648 is provided. The second camber 648 has a same curvature as that of the second recess 450.

Similarly, the arm 66 includes a bent portion 662, a clamp plate 664, and a free end 666. A second camber 668 is also provided at the intersection of the clamp plate 664 and the free end 666. Therefore, a second space is bounded by the installation plate 62, and the arms 64 and 66. A volume of the second space is determined by the extent that the bent portions 642, 662 are bent, and the length of the clamp plates 644, 664. Thus, the clamp plates 644, 664 extend toward each other.

In assembly, the second slide 40 is received in the first slide 20, with the first cambers 448, 468 slidably engaging with the first recesses 244, 264, respectively, and the second curves 444, 464 extending out of the space bounded by the bottom wall 22 and the sidewall 24, 26. The distance between the flat panel 424 and the bottom wall 22 mainly depends on the inclination of the connection portion 426. The distance between the flat panel 424 and the bottom wall 22 further determines a volume of a third space between the first slide 20 and the second slide 40, bounded by the bottom wall 22 of the first slide 20, the connection portions 426 and the flat panel 424 of the second slide 40.

The third slide 60 is slidably sleeved over the second curves 444, 464 of the second slide 40, with the second cambers 648, 668 engaging with the second recesses 450, 470, respectively, and the second curves 444, 464 being received in the second space bounded by the installation plate 62, and the arms 64, 66. The distance between the installation plate 62 of the third slide 60 and the flat panel 424 of the second slide 40 depends on the extent that the second curves 444, 464 extends away from the connection part 426, and the volume of the second space. The distance between the installation plate 62 and the flat panel 424 further determines the the volume of a fourth space between the second slide 40 and the third slide 60.

Some lubricant can be added on the sliding contact surfaces, which can result in smooth movement during pushing and pulling of the slides, and facilitates use of the slide rail.

The contact between the slides can be of any other form if only the slides are contacted in a position making the two slides apart from each other.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. A slide rail comprising a first slide, a second slide, and a third slide, each of the first slide, the second slide, and the third slide comprising a pair of sidewalls, wherein the first slide further comprises a bottom wall, the pair of the sidewalls of the first slide are extended from two edges of the bottom wall respectively;

the second slide is received in a space bounded by the bottom wall and the sidewalls of the first slide; the sidewalls of the second slide extend out from the space to contact the sidewalls of the third slide;

each of the sidewalls of the second slide comprises a first curve contacting the corresponding sidewall of the first slide, a first connection portion extending from the first curve, and a second curve extending from the first connection portion; the two first connection portions extend toward each other, extension ends of the two second curves extend away from each other, thereby forming recesses in respective inner surfaces of the second curves; and each of the sidewalls of the third slide comprises a clamp plate; the two clamp plates extend toward each other and extension ends thereof are received in the corresponding recesses of the second curves, and the extension end of each of the clamp plates is turned back to form a free end, and each of the free ends is parallel with the corresponding clamp plate.

2. The slide rail as described in claim 1, wherein the third slide comprises an installation plate, the two sidewalls of the third slide are extended from two edges of the installation plate respectively, the second curves of the sidewalls of the second slide extend out of the space bounded by the bottom wall and the sidewalls of the first slide to be received in a space bounded by the installation plate and the sidewalls of the third slide.

3. The slide rail as described in claim 1, wherein the second slide further comprises a plate, the sidewalls of the second slide are symmetrically extended from two edges of the plate respectively.

4. The slide rail as described in claim 3, wherein the plate comprises a flat panel and two end portions, the first curves of the two sidewalls of the second slide are connected to the two end portions, respectively.

5. The slide rail as described in claim 4, wherein the plate further comprises two second connection portions connecting the flat panel and the two end portions, respectively, the two second connection portions are inclined to the flat panel and the two end portions, the end portions are parallel with the flat panel.

6. The slide rail as described in claim 1, wherein the third slide comprises an installation plate, the sidewalls of the third slide are symmetrically extended from two edges of the installation plate respectively.

7. The slide rail as described in claim 6, wherein each of the sidewalls of the third slide further comprises a bent portion, the bent portions connecting the installation plate and the clamp plates.

8. A slide rail comprising:

a first slide comprising a first plate and two first side plates extending from a same side of the first plate; and a second slide received in the first slide, the second slide comprising a second plate comprising a flat panel and two second connection portions that are symmetrically inclined to the flat panel, and two second side plates extending from the second plate; the two second side plates configured for contacting the two first side plates;

wherein the second plate further comprises two end portions being connected to the two second connection portions respectively and parallel with the flat panel; each of the second side plates comprises a first curve being connected to the corresponding end portion and contacting the corresponding first side plate, a first connection portion extending from the first curve in a direction approaching the corresponding second connection portion, and a second curve extending from the first connection portion; extension ends of the two second curves extend in a direction away from the corresponding second connection portions, thereby forming recesses in respective inner surfaces of the second curves; the slide rail further comprises a third slide comprising two clamp plates extending toward each other; and extension ends of the clamp plates are received in the corresponding recesses of the second curves, and the two first side plates are extended from two opposite edges of the first plate and bent inward to be parallel to and over the first plate.

9. The slide rail as described in claim 8, wherein at least the two first side plates or the two second side plates are extended in a direction away from the first plate or the second plate, for generating a distance between the first plate and the second plate.

10. The slide rail as described in claim 8, wherein the third slide further comprises a third plate and two third side plates, so that the third slide is slidable relative to the second slide.

11. The slide rail as described in claim 10, wherein the two third side plates are extended from two edges of the third plate respectively.

12. The slide rail as described in claim 10, wherein each of the third side plates comprises a bent portion, the bent portions connecting the third plate and the clamp plates.

13. The slide rail as described in claim 12, wherein the clamp plates extend in a direction away from a side of the third plate.

14. The slide rail as described in claim 12, wherein the second side plates and the third side plates are contacted at the extension ends of the clamp plates, generating a distance between the second plate and the third plate.

15. The slide rail as described in claim 8, wherein the extension end of each of the clamp plates is turned back to form a free end, and each of the free ends is parallel with the corresponding clamp plate.

16. The slide rail as described in claim 4, wherein the first connection portions of the sidewalls of the second slide are parallel with the end portions.

* * * * *